US006201509B1

(12) United States Patent
Zhang et al.

(10) Patent No.: US 6,201,509 B1
(45) Date of Patent: Mar. 13, 2001

(54) COAXIAL CONTINUOUS TRANSVERSE STUB ELEMENT DEVICE ANTENNA ARRAY AND FILTER

(75) Inventors: Zhijun Zhang; Magdy F. Iskander; Zhengqing Yun, all of Salt Lake City, UT (US)

(73) Assignee: University of Utah Research Foundation, Salt Lake City, UT (US)

( * ) Notice: Subject to any disclaimer, the term of this patent is extended or adjusted under 35 U.S.C. 154(b) by 0 days.

(21) Appl. No.: 09/434,886

(22) Filed: Nov. 5, 1999

(51) Int. Cl.[7] ..... H01Q 9/04; H01Q 1/12

(52) U.S. Cl. ..... 343/791; 343/785; 343/787; 343/890

(58) Field of Search ..... 343/785, 787, 343/790, 791, 792, 890; H01Q 13/00, 9/04, 1/12

(56) References Cited

U.S. PATENT DOCUMENTS

| | | | |
|---|---|---|---|
| 5,266,961 | 11/1993 | Milroy | 343/772 |
| 5,349,363 | 9/1994 | Milroy | 343/772 |
| 5,361,076 | 11/1994 | Milroy | 343/772 |
| 5,412,394 | 5/1995 | Milroy | 343/785 |
| 5,469,165 | 11/1995 | Milroy | 342/13 |
| 5,483,248 | 1/1996 | Milroy | 343/785 |
| 5,485,165 | 1/1996 | Foard | 343/741 |
| 5,583,524 | 12/1996 | Milroy | 343/772 |
| 5,604,505 | 2/1997 | Matterer | 343/772 |
| 5,771,567 | 6/1998 | Pierce et al. | 29/600 |

*Primary Examiner*—Don Wong
*Assistant Examiner*—Hoang Nguyen
(74) *Attorney, Agent, or Firm*—Morriss, Bateman, O'Bryant & Compagni

(57) ABSTRACT

A continuous transverse stub element array structure which forms a coaxial geometry formed from a plurality of cylindrical segments, wherein each of the cylindrical segments has a rim at a top end and a bottom end, wherein each rim extends transversely away from the cylindrical segment relative to a longitudinal axis thereof to thereby form a stub element, wherein the individual cylindrical transverse stub elements are aligned end-to-end to thereby form a coaxial cable structure which surrounds a central core material. The series of these stubs form reactive or radiating elements for microwave, millimeter-wave, and quasi-optical filters and antennas. Purely reactive elements are formed by leaving the conductive coating on the terminus of the stub elements, whereas radiating elements are formed when stub elements of moderate radius are opened to free space. For tunability, each of the plurality of cylindrical segments and the central axis materials are coated with a conductive material which is ferro-electrical or liquid crystal in nature. The individual stub elements are separated from each other by air gaps or an appropriate material.

36 Claims, 9 Drawing Sheets

Thickness of substrate = 0.1 mm

Thickness of substrate = 0.3 mm

COAXIAL CONTINUOUS TRANSVERSE STUB ELEMENT DEVICE ANTENNA ARRAY AND FILTER

BACKGROUND

1. The Field of the Invention

This invention relates generally to antennas, filters and transmission lines. More specifically, the invention relates to a new configuration of a continuous transverse stub element array structure which is formed in a coaxial arrangement to provide superior omnidirectional performance at microwave, millimeter, and quasi-optical wavelengths.

2. The State of the Art

The state of the art of antennas, antenna arrays, parallel plate waveguides, filters and couplers beginning at microwave frequencies is characterized, for example, by several types of more conventional designs of mono-poles or dipoles, slotted waveguide arrays, printed patch arrays, and reflector and lens systems as mobile or base station terminal antennas. These designs are used to build high gain antenna arrays, adaptive arrays, phased arrays and smart antennas. Furthermore, when moving into frequencies which are greater than 20 GHz and commonly known as millimeter wave and quasi-optical frequencies, antennas and filters suffer from relatively low Q factors due to high dissipative conductor and dielectric losses, interconnect losses, and from relatively difficult fabrication due to dimensional tolerances. Accordingly, antenna and filter designs have moved to more advantageous configurations which are known as continuous transverse stub element array structures which can be radiating (antenna) or reactive (filter).

The known configurations and methods of fabricating these continuous transverse stub element array structures are generally taught, for example, in U.S. Pat. Nos. 5,266,961, 5,412,394, 5,583,524, 5,604,505 and 5,771,567 to list but a few. In essence, these patents teach that a continuous transverse stub element residing in one or both conductive plates of a parallel plate waveguide is employed as a coupling, reactive, or radiating element in coupler, filter and antenna designs. These patents contributed to the parallel-plate continuous transverse array designs that are characterized by pencil beam patterns.

In the planar-type prior art, a typical continuous transverse stub element array structure will include a dielectric element forming a plane which has a second dielectric element which extends transversely to the plane to form a stub. A first conductive element is disposed coextensive with the dielectric element forming the plane, and a second conductive element is disposed along a surface of the second dielectric stub element.

FIG. 1 is provided as a close-up illustration of the prior art which shows a typical dielectric plane 10 and stub element 12. FIG. 2 is provided to show a perspective view of an array of stub elements 14 in a planar array 16.

It is taught in the prior art that purely-reactive stub elements are realized through conductively terminating (a short circuit) or by narrowing (an open circuit) the terminus of the stub element. Radiating elements are formed when stub elements of moderate height are opened to free space. Precise control of stub element coupling or excitation by way of coupling of parallel plate waveguide modes is accomplished through variation of longitudinal stub element length, stub element height, parallel plate separation, and the properties of the parallel plate and the stub element media.

The prior art is also characterized by teaching that continuous transverse stub elements can be arrayed to form planar apertures and structures of arbitrary area which are comprised of a linear array of continuous transverse stub elements fed by a conventional line-source or sources.

The prior art teaches that the transverse stub elements are varied by modifying their height, width, length, and cross section. Other cited variations include changing the number of stub elements, and adding additional structures to the basic stub element. However, these arrays structure fail to provide a coaxial arrangement for a filter or antenna array system, or any means of conveniently providing a signal feed thereto.

It would be an advantage over the prior art to provide a different continuous transverse stub element array design which can provide a high Q-factor filter and a low cost antenna array with two-dimensional beam steering capability. It would be another advantage to provide omnidirectional capabilities at microwave, millimeter wave and quasi-optical wavelengths which would permit construction of a small and mobile array design. It would be a further advantage to provide a large beam scan width in a new continuous transverse stub element array design which provided low loss and had improved impedance matching.

OBJECTS AND SUMMARY OF THE INVENTION

It is an object of the present invention to provide a new and low cost configuration for a continuous transverse stub element array structure for both antenna array and filter designs.

It is another object to provide the new continuous transverse stub element antenna array which is omnidirectional at millimeter frequencies.

It is another object to provide the new continuous transverse stub element array which can accomplish two-dimensional steering using ferro-electric or liquid crystal materials.

It is another object to provide the new continuous transverse stub element array which utilizes thin film technology for the ferro-electric or liquid crystal materials to obtain uniform distribution for improved steering characteristics.

It is another object to provide the new continuous transverse stub element array structure which can operate over a broad frequency band.

It is another object to provide the new continuous transverse stub element array structure which can be used for base stations or mobile units.

It is another object to provide the new continuous transverse stub element array structure which is characterized by low losses and superior impedance matching.

It is another object to provide the new continuous transverse stub element array structure in the form of a coaxial design which provides improved tolerance for manufacturing errors.

The preferred embodiment of the present invention is a continuous transverse stub element array structure which forms a coaxial geometry formed from a plurality of cylindrical segments, wherein each of the cylindrical segments has a rim at a top end and a bottom end, wherein each rim extends transversely away from the cylindrical segment relative to a longitudinal axis thereof to thereby form a stub element, wherein the individual cylindrical transverse stub elements are aligned end-to-end to thereby form a cable structure which surrounds a central axis material. A linked series of these stubs form reactive or radiating elements for microwave, millimeter-wave, and quasi-optical wavelength filters and antennas. Purely reactive elements are formed by leaving the conductive coating on the terminus of the stub elements, whereas radiating elements are formed when stub elements of moderate radius are opened to free space. Where tunability of the array structure is desired, each of the plurality of cylindrical segments and the central axis material are coated with a conductive material which is ferro-electric or liquid crystal in nature. The individual stub elements are separated from each other by air gaps or an appropriate material.

In a first aspect of the invention, the ferro-electric or liquid crystal material is applied to the dielectric material of the individual stub elements using thin-film coating technologies.

In a second aspect of the invention, the thickness of the ferro-electric or the liquid crystal material is modified depending upon the desired characteristics of the array which are a function of the thickness of the ferro-electric or liquid crystal material, and the applied voltages.

In a third aspect of the invention, precise control of element coupling or excitation (amplitude and phase) via coupling of coaxial waveguide modes is accomplished through variation of longitudinal stub length, dish stub radius, interior and exterior radius of the coaxial structure, and the properties of the coaxial structure and stub filling media.

In a fourth aspect of the invention, coaxial continuous transverse stub elements are arrayed to form a linear array of continuous transverse stub elements fed by a conventional coaxial source.

In a fifth aspect of the invention, conventional methods of filter or antenna array synthesis and analysis may be employed in either the frequency or spatial domains to thereby construct stub elements and arrays to meet substantially any application.

In a sixth aspect of the invention, the principles of the present invention are applicable to all horizontal omnidirectional arrays, phased arrays, adaptive arrays and smart antenna applications at microwave, millimeter-wave and quasi-optical wavelength frequencies.

In a seventh aspect of the invention, advantages in millimeter-wave and quasi-optical wavelength filter designs are realized due to the enhanced reproducibility and relative low-loss (high Q) of the continuous transverse stub elements as compared to stripline, microstrip elements.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Reference will now be made to the drawings in which the various elements of the present invention will be given numerical designations and in which the invention will be discussed so as to enable one skilled in the art to make and use the invention. It is to be understood that the following description is only exemplary of the principles of the present invention, and should not be viewed as narrowing the claims which follow.

The present invention has application to both radiating and non-radiating (reactive) array structures. Accordingly, the array structures to be described hereinafter are capable of finding application in both antenna and filter technologies, respectively. The significant differences in structure of an antenna array and a filter array arise in the structure of the transverse stub elements.

Figure 1:
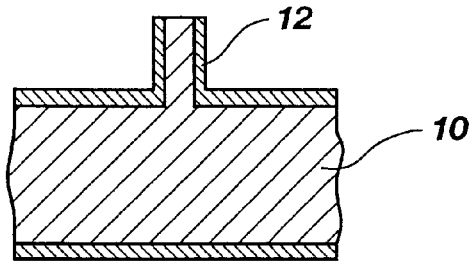
Fig. 1 (PRIOR ART)
FIG. 1 is a close-up cross-sectional view of a single transverse stub element as taught in the prior art.
Figure 2:
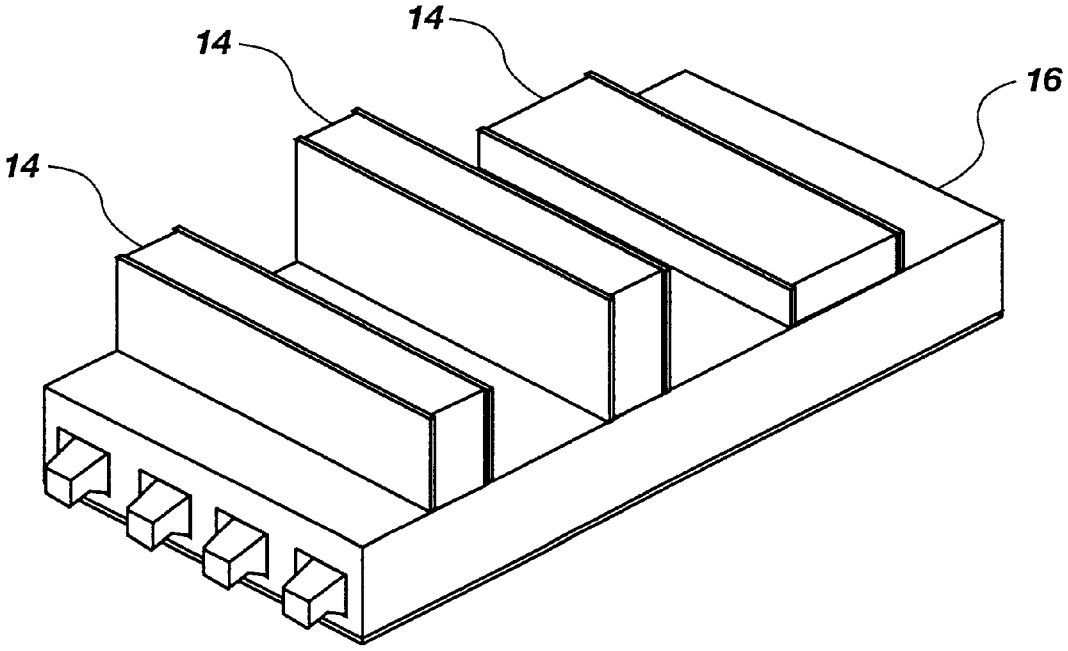
Fig. 2 (PRIOR ART)
FIG. 2 is a perspective view of a continuous transverse stub element planar array as taught in the prior art.
Figure 3:
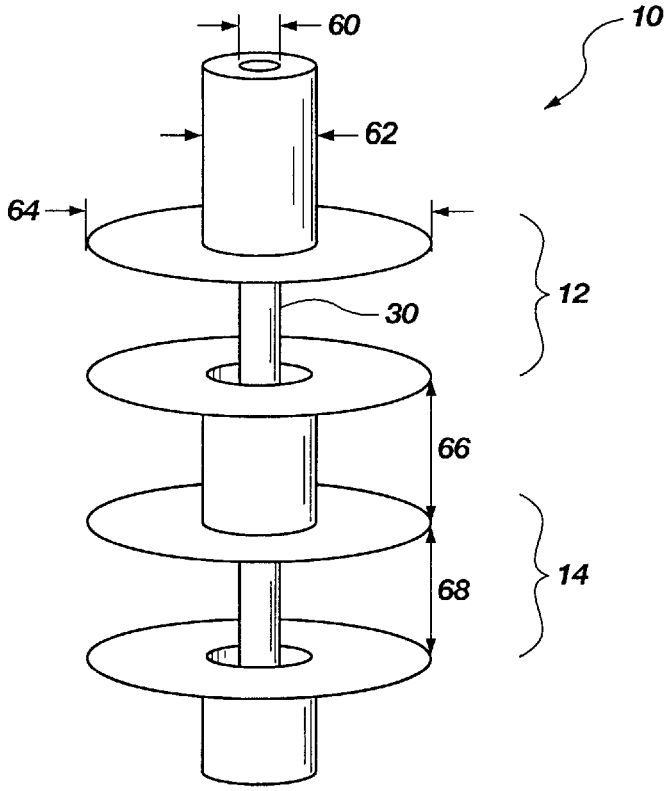
FIG. 3 is a perspective view of the presently preferred embodiment which is made in accordance with the principles of the present invention.

The geometry of the presently preferred embodiment of the present invention is illustrated in FIG. 3. FIG. 3 is a perspective view of two continuous transverse stub elements 12, 14, and a core element 30 with which the stub elements are coaxial. This basic geometry, the coaxial relationship of the stub elements 12, 14, gives rise to one of the most significant advantages of the preferred embodiment. Specifically, the array structure 10 of FIG. 3 is omnidirectional. The planar array structures described in the prior art all fail to achieve this function.

Figure 4:
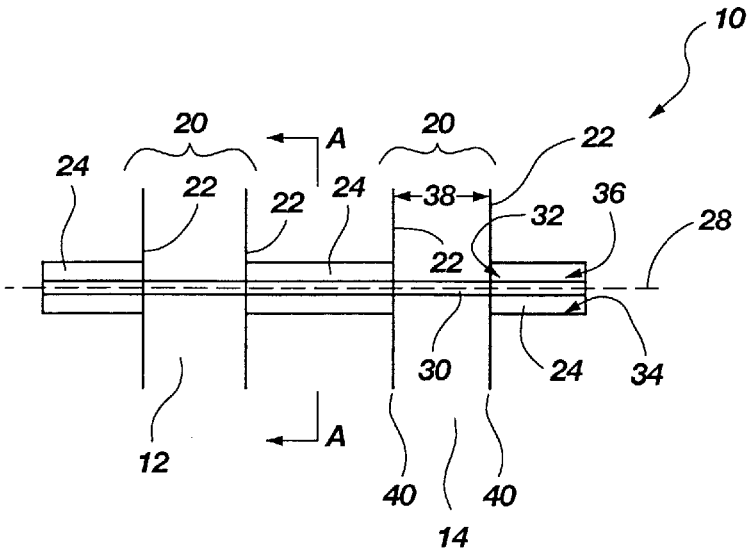
FIG. 4 is a cross-sectional profile view of the coaxial continuous transverse stub element array structure embodiment shown in FIG. 3.

FIG. 4 is provided as an elevational cut-way view of the continuous transverse stub element array of FIG. 3. Specifically, FIG. 4 illustrates that a single transverse stub element 20 is formed at the junction of the rims 22 of two cylindrical segments 24. The middle cylindrical segment is therefore an integral component of a first transverse stub element 12 and a second transverse stub element 14. Each cylindrical segment 24 is generally in the form of a spool, having a rim 22 at each end which is generally transverse to a longitudinal axis 28 of the cylindrical segment.

To be in a true coaxial relationship as that term should be understood in this document, a cylindrical segment 24 does not only share the longitudinal axis 28 with a core element 30, but it is also electrically isolated therefrom.

As a practical matter, some material 36 must fill the space 32 between an inner surface 34 of the cylindrical segment 24. Such a material 36 is known to those skilled in the art of continuous transverse stub elements. For example, the filler material 36 can be selected from such materials as TEFLON™, low density foam, rexolite, polyethylene, stycast, lexan and other materials which have similar electrical and mechanical properties. The filler material 36 provides basic structural integrity to the array structure 10.

The array structures 10 of FIGS. 3 and 4 are shown in this embodiment as not having a filler material directly between the rims 22 of the cylindrical segments 24. This is only one configuration of the array structure 10. A filler material can be provided to fill the gap 38 between the rims 22. This filler material is typically comprised of the same materials which are used as the filler material 36, with the exception of air.

A final step in obtaining the desired array structure 10 is the application of a uniformly conductive coating on the exterior surfaces (exactly which surfaces? Please point to all surfaces in FIG. 4) of the cylindrical segment 24. The uniformly conductive coating is typically a thin film of an appropriately conducting material, as is known to those skilled in the art of continuous transverse stub elements.

Figure 5:
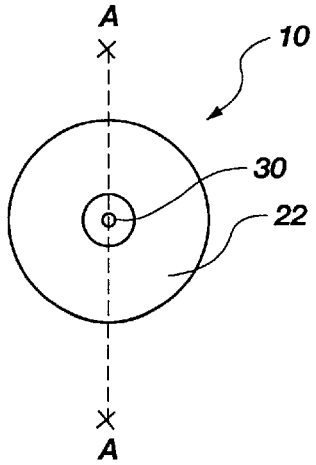
FIG. 5 is an end view of the coaxial continuous transverse stub element array structure shown in FIG. 4 along line A—A.

FIG. 5 is provided as an end view of the array structure 10 shown in FIG. 4 along points A—A. Note that in the presently preferred embodiment, the rim 22 is generally circular, as is the core element 30.

Fabrication of the coaxial array structure shown in FIG. 4 is possible through machining, extruding or molding. It should also be remembered that the material used for the cylindrical segments 24 is a dielectric material, as is known to those skilled in the art. After the shape of the dielectric cylindrical segments 24 is completed, the segments are coated or plated with the uniform conductive coating.

The coaxial structure of the array is advantageously forgiving. In other words, the design has good tolerance for manufacturing errors.

Finally, if the coaxial array structure 10 is to be used in an antenna array, the ends 40 of the transverse stub elements 20 need to be ground or machined in order to create radiating elements when there is a filler material 36 in the gap 38, because the conductive coating will otherwise electrically connect the rims 22.

FIG. 3 also includes a number of dimensions which are provided for illustration purposes only and must not be considered limiting. These dimensions can be varied to suit the needs to the application to which the present invention is applied. Nevertheless, dimension 60 is 0.25 mm, dimension 62 is 0.575 mm, dimension 64 is 6 mm, dimension 66 is 3.5 mm, and dimension 68 is 5 mm.

Figure 6:
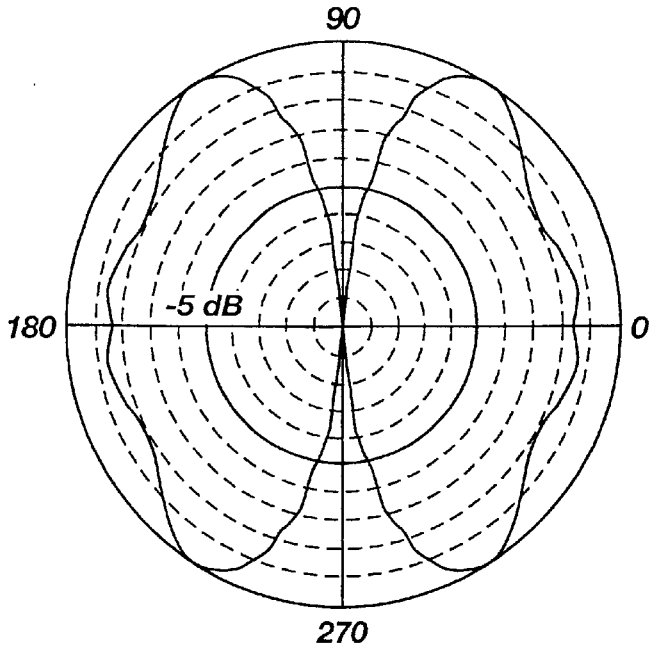
FIG. 6 is a graph of the radiation pattern from a single coaxial continuous transverse stub element array structure.

FIG. 6 is provided to illustrate the radiation pattern of a single transverse stub element of the coaxial array structure shown in FIGS. 3, 4 and 5 when used in a radiating application.

Figure 7:
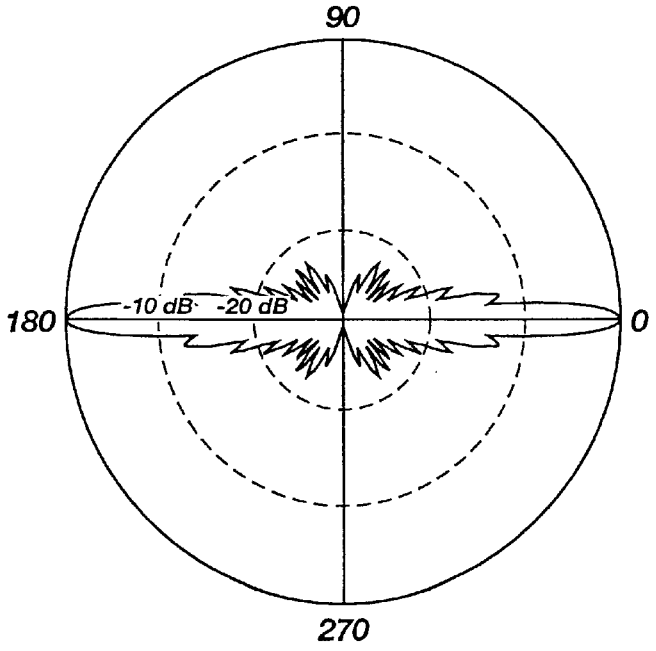
FIG. 7 is a graph of the radiation patterns created by 18 elements of a coaxial continuous transverse stub element antenna array structure.

FIG. 7 is provided to illustrate the radiation pattern of 18 stub elements of a continuous transverse stub element coaxial array.

Omnidirectionality of the preferred embodiment shown in FIGS. 3, 4 and 5 is only one of the advantages of the present invention over the prior art. There are other advantageous features of the coaxial geometry, and of materials applied to the array structure to obtain improved performance, as will be explained.

It is first observed that without any modifications, the preferred embodiment shown in FIG. 3 is capable of achieving improved base station and mobile performance. The array structure is advantageously utilized as a base station antenna array because it is omnidirectional. Furthermore, the small size of the coaxial antenna array structure 10 makes it easy to move. The design is not only low cost, but it also operates in the microwave, millimeter and quasi-optical frequency ranges. In other words, the antenna array structure at least operates in frequency ranges of 20 Ghz to 60 Ghz. Another advantage of the coaxial antenna array structure is the fact of good impedance matching because of the coaxial design. Typically, an impedance of 50 ohms can be achieved, making it simple to provide a coaxial feed for signal transmission and reception when the array structure is used as an antenna.

The advantages of the coaxial array structure describe above are significant. However, there are other advantageous structures which can be easily obtained from the basic design. Specifically, it was discovered that the present invention is also capable of two dimensional steering. This makes the coaxial array structure ideal for such applications as satellite communications which typically operate in millimeter wave frequencies.

Figure 8:
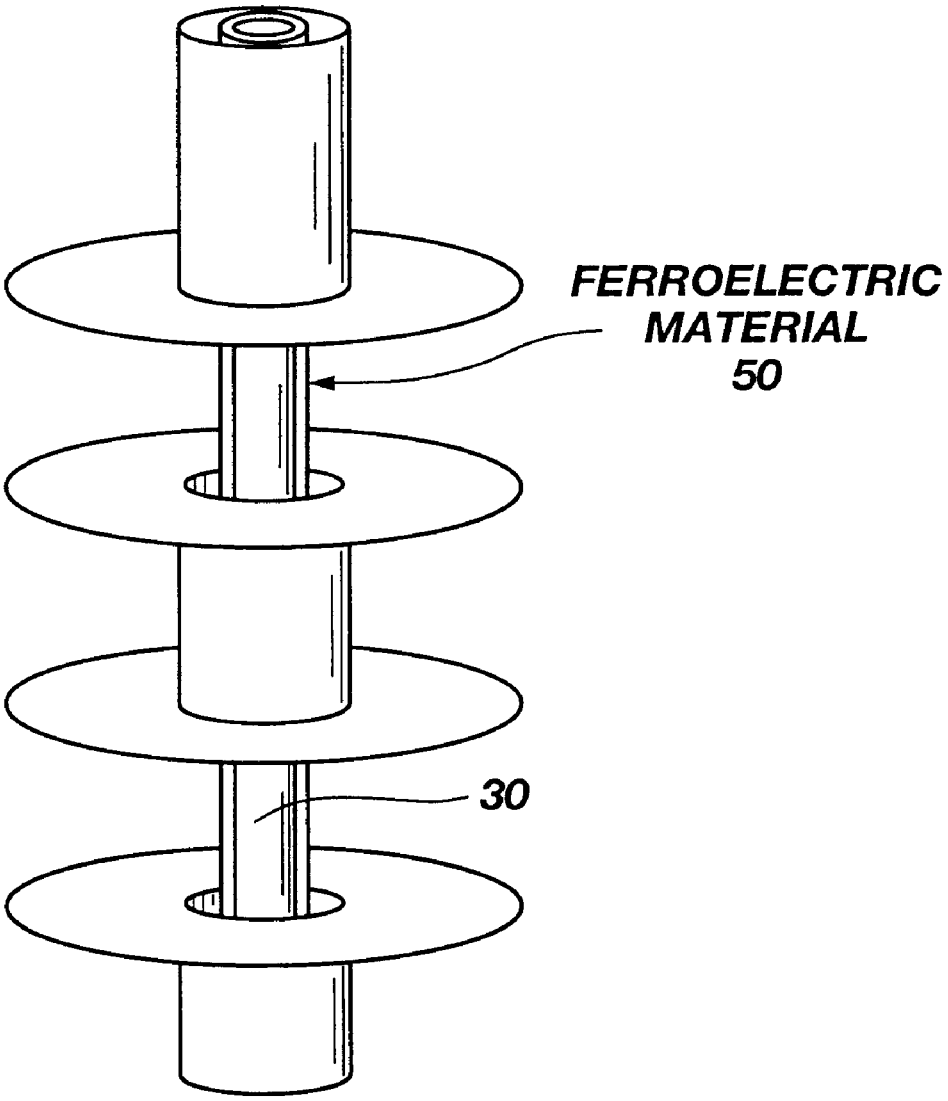
FIG. 8 is a perspective view of a coaxial continuous transverse stub element array structure which has a ferro-electrical material applied for steering purposes.

The present invention has achieved a beam scan capability of −60° to +60° with low loss (a high Q factor). The significant two dimensional scanning abilities of the present invention were obtained in an alternative embodiment shown in FIG. 8. FIG. 8 is identical to FIG. 3, with the addition of a ferro-electrical material 50 to the core element 30.

As a practical matter, the ferro-electrical material 50 is applied as a thin film using an appropriate thin film application technology, such as spraying. It is envisioned that more than one layer of the ferro-electric material can be applied to create multiple layers.

As known to those skilled in the art, steering is achieved by applying a voltage to the ferro-electric material 50. However, the amount of voltage to apply to achieve the desired scanning and steering capabilities varies greatly depending upon the geometry and the nature of the selected ferro-electric material.

In the present invention, one such ferro-electric material which demonstrates promising results is Barium Strontium Titanium Oxide (BSTO). BSTO advantageously changes its dielectric properties with an applied bias voltage, thereby achieving the desired tunability and scanning capabilities. It is also noted that BSTO can also function as a filler material in a waveguide feed section of the coaxial array structure.

The thickness of BSTO results in changes in the required bias voltage. This can affect the tunability of the array structure, where tunability is a function of an unbiased dielectric constant and the biased dielectric constant as shown in Equation 1.

Equation 1:

$$\text{Tunability} = \frac{\varepsilon_1 - \varepsilon_2}{\varepsilon_1}$$

It has been observed that practical values of applied biasing voltage have been between 0.7 to $$3.0\ \frac{V}{\mu m}.$$

Furthermore, another desired characteristic of dielectric loading when using BSTO is that it has a low loss tangent.

The selection of BSTO as a useful ferro-electric material for scanning has also required experimentation in order to obtain the desired tunability characteristics. Table 1 is provided as a brief example of some of the experimental results which show the advantageous characteristics of BSTO having 40% oxide.

Table 2 is provided as a means of illustrating dielectric and conductor losses. The table is only illustrative of some of the results that were obtained using BSTO 40% oxide, unbiased and biased.

An important consideration when designing a coaxial array structure of the present invention is the tradeoff between thickness of the ferro-electric material and conductor losses in decibels. Experimentation has shown that the present invention provides good performance at low$\epsilon$ and relatively large thickness of the substrate, but a drop off in performance, as expected, with high$\epsilon$ and a thin substrate which is better for two dimensional beam steering.

Figure 9:
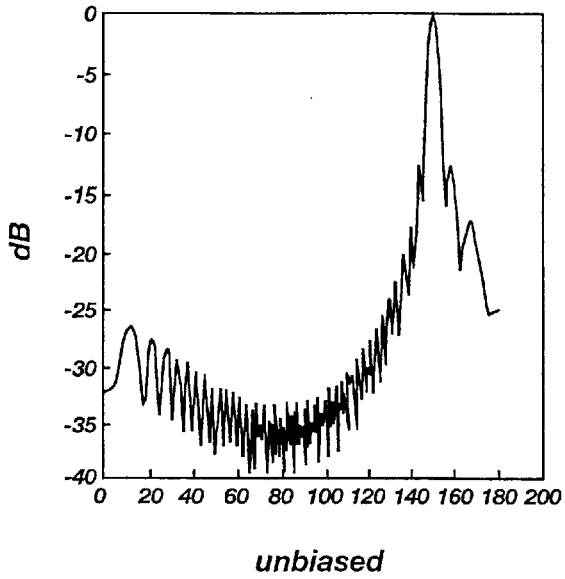
FIG. 9 is a graph of a radiation pattern for a 50 element coaxial continuous transverse stub element array structure which is unbiased.
Figure 10:
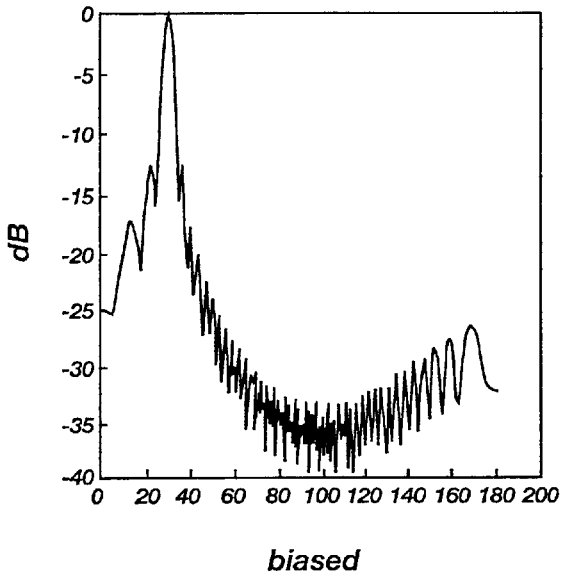
FIG. 10 is a graph of a radiation pattern for a 50 element coaxial continuous transverse stub element array structure which is biased.
Figure 11:
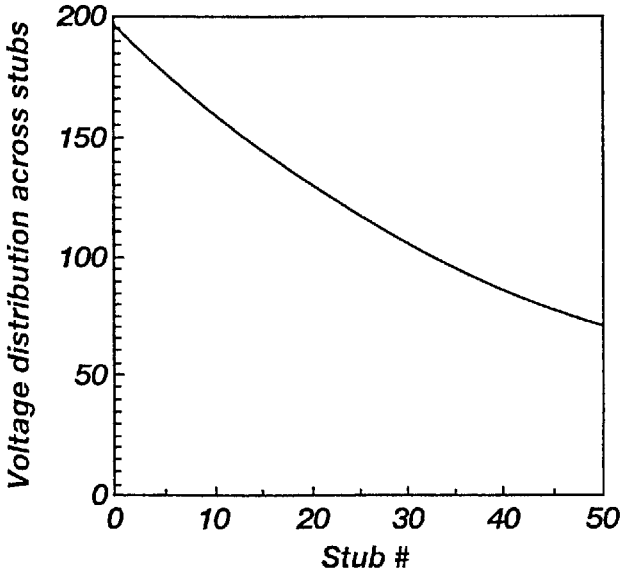
FIG. 11 is a graph of a voltage distribution across the 50 stub elements for the (biased?/unbiased?) configuration.

FIGS. 9, 10 and 11 are provided as illustrations of a radiation pattern for a 50 element coaxial continuous transverse stub element array using BSTO 40% oxide III as the ferro-electric material, where FIG. 9 is unbiased, and FIG. 10 is biased. FIG. 11 illustrates the voltage distribution across the stubs for the (biased?/unbiased?) scenario.

Figure 12:
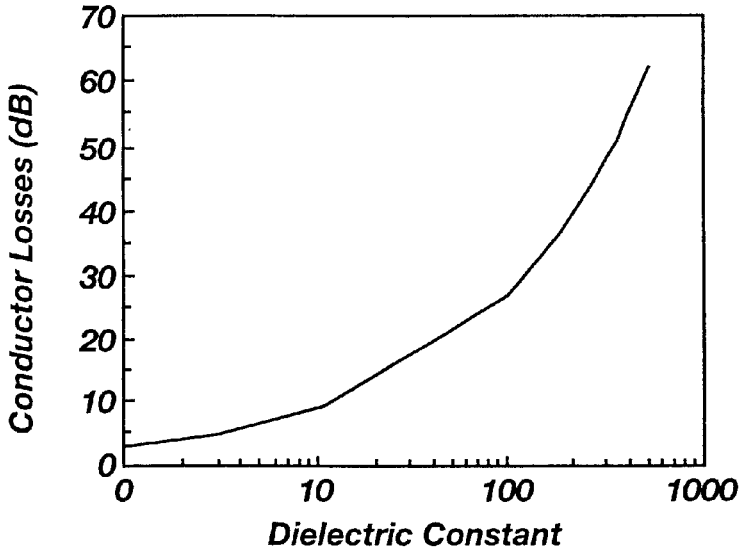
FIG. 12 is a graph of ohmic loss as a function of dielectric loading.
Figure 13:
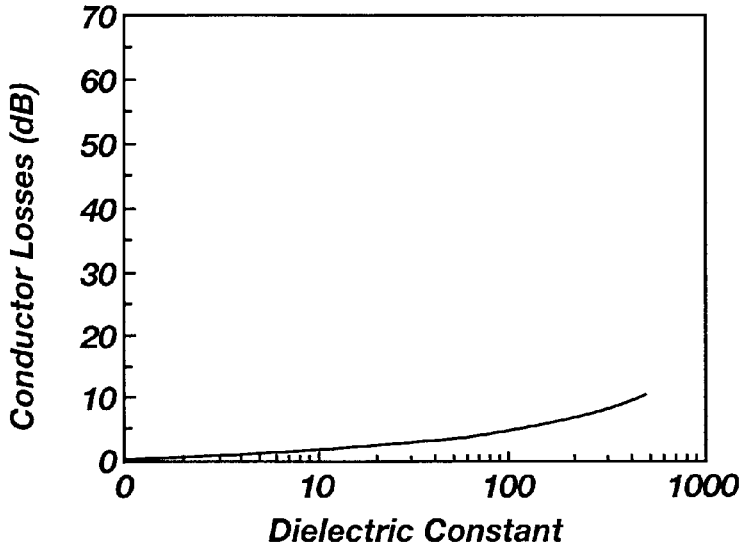
FIG. 13 is a graph of ohmic loss as a function of dielectric loading.

Some of the tradeoffs to consider when designing a coaxial continuous transverse stub element array antenna include the increased losses at lower substrate (BSTO) thicknesses, the higher biasing voltage required for thicker substrates, and the concern for multimode propagation at large heights. These considerations are illustrated in FIGS. 12 and 13.

With the change in dielectric properties of the ferro-electric material, waveguide impedance also changes. With the contribution of reflected voltage, the phase difference between radiating elements changes in an inconsistent manner. The result is a deterioration in a radiation pattern.

It has been discovered that one method for overcoming this difficulty is to change the waveguide dimensions to thereby achieve continued impedance matching, and therefore controlled distance between radiating elements. This method requires that the biasing voltage be variable.

If an average value of the impedance is implemented in the design, deterioration of the radiation pattern may be overcome by using larger waveguide impedance values. As a practical matter, a greater number of elements may be required to obtain practical values of gain.

In an alternative embodiment of the present invention, the ferro-electrical material used for scanning purposes can be replaced by a liquid crystal material. The liquid crystal advantageously is less lossy than the ferro-electric materials described above. In addition, the liquid crystal material is less expensive. As a tradeoff, tunability or steering of a beam is not as good as with BSTO 40% oxide III.

The preferred and alternate embodiments of the present invention described above have uniform circular rims on a cylindrical segment body. However, there are variations to the geometry of the stub elements which can affect the performance of the present invention. The figures which follow are provide so as to illustrate some of the various geometries. In essence, the geometry of both the core element and the cylindrical segments of the stub elements can be modified. For example, the modifications include, but should not be considered limited to, changes in the length and diameter of the cylindrical segments.

Other modifications are shown in the following figures. Before describing the figures, it should be remembered that all of these modifications can be combined with each other.

Figure 14:
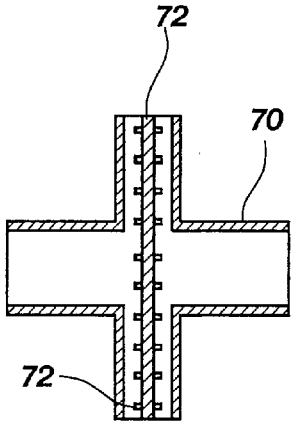
FIG. 14 is a cross-sectional profile view of a stub element with a corrugated core element.

FIG. 14 is a cut-away view of a single coaxial transverse stub element 70 with a radiating structure. The core element 72 is corrugated, which is also referred to as a slow-wave structure.

Figure 15:
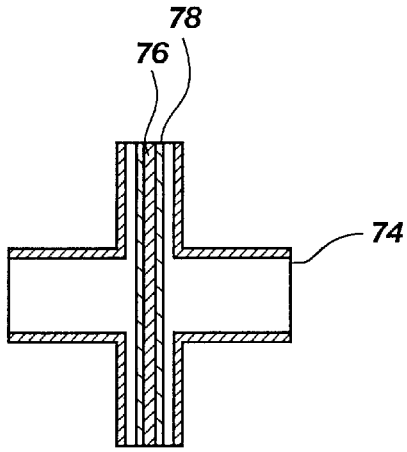
FIG. 15 is a cross-sectional profile view of a stub element with a core element made from two conductive materials.

FIG. 15 is a cut-away view of a single coaxial transverse stub element 74 with a radiating structure. The core element is now comprised of multiple dielectric materials 76 and 78. FIGS. 14 and 15 describe embodiments in which minimal weight, complex frequency dependence, or precise phase velocity control is required.

Figure 16:
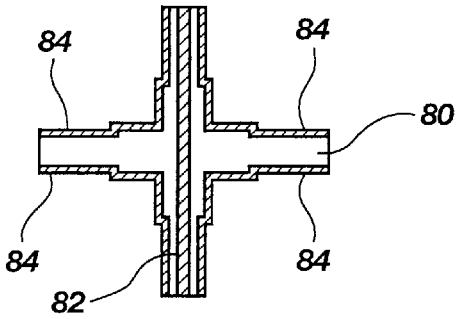
FIG. 16 is a cross-sectional profile view of a stub element with a step-wise segmented cylindrical segment and rims.

FIG. 16 is a cut-away view of a single coaxial transverse stub element 80 which shows a step-wise segmented cylindrical segment 82, and step-wise segmented rims 84. The step-wise segmentation can go inwards or outwards. This configuration is useful for modifying coupling and/or to broaden frequency bandwidth characteristics.

Figure 17:
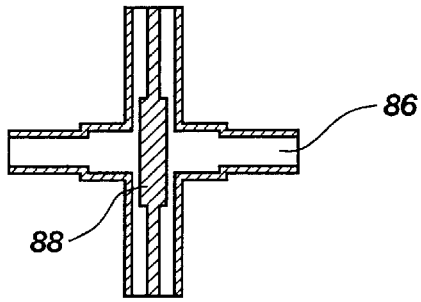
FIG. 17 is a cross-sectional profile view of a stub element with step-wise segmented rims and a step-wise segmented core element.

FIG. 17 is a cut-away view of a single coaxial transverse stub element 86 which includes a step-wise segmented core element 88.

Figure 18:
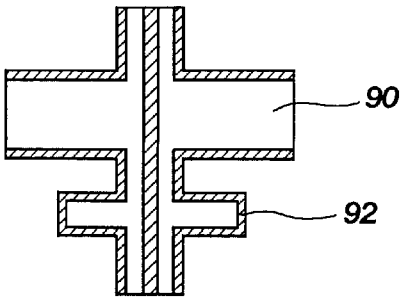
FIG. 18 is a cross-sectional profile view of two stub elements, where one element is radiating and the other is reactive.

FIG. 18 is a cut-away view of a two coaxial transverse stub elements 90, 92, where a first stub element 90 is larger and radiating, and where the second stub element is smaller and reactive 92. Obviously, the size of the radiating and reactive stub elements can be reversed, and could also include the features of tapering and step-wise segmentation. The pair of radiating 90 and reactive 92 stub elements is illustrative of a matched couplet. This pairing is useful for suppression of coupler-radiated reflections through destructive interference of their individual reflection contributions. Matched couplets are useful in antenna arrays where it is desired to scan the beam at or through a broadside.

Figure 19:
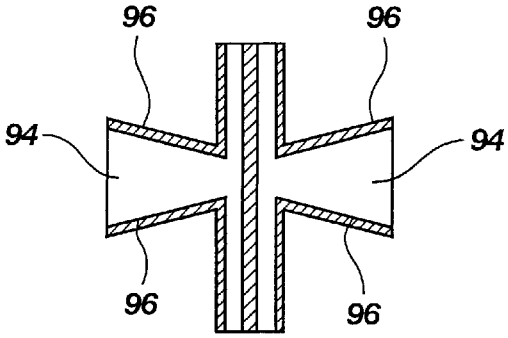
FIG. 19 is a cross-sectional profile view of a stub element with tapering rims.

FIG. 19 is a cut-away view of a single coaxial transverse stub element 94 which includes rims 96 which are tapered. The tapering can occur in either direction, with one or both being tapered. Alternatively, it should now be obvious that step-wise segmentation can be included in the tapering of the cylindrical segment 98 and in the rims 96. The tapering is able to broaden frequency bandwidth characteristics.

Figure 20:
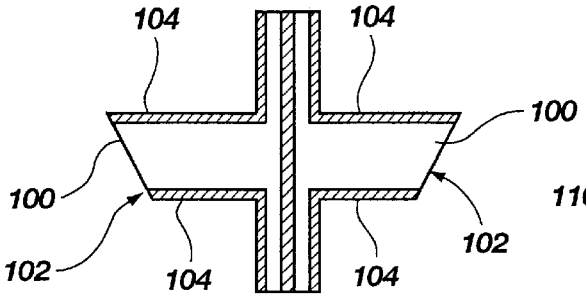
FIG. 20 is a cross-sectional profile view of a stub element with an inclined radiation surface.

FIG. 20 is a cut-away view of a single coaxial transverse stub element 100 which includes the feature of an inclined radiation surface 102 created by rims 104 having different diameters. Adjusting the degree of inclination of the radiation surface 102 results in a change in the radiation pattern of the stub element 100. Specifically, the peak pattern can be controlled so as to point in a desired axial direction.

Figure 21:
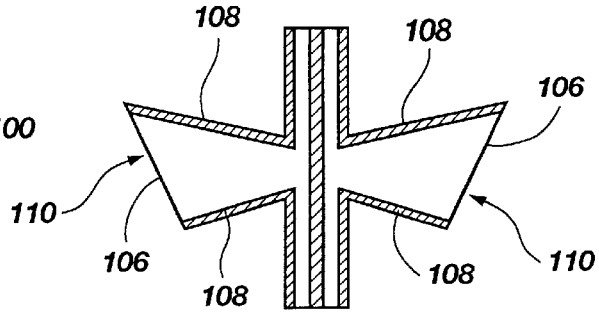
FIG. 21 is a cross-sectional profile view of a stub element with an inclined radiation surface and tapering rims.

FIG. 21 is a cut-away view of a single coaxial transverse stub element 106 which combines tapering of the rims 108 with different diameters, thereby creating the inclined radiation surface 110. The result is the ability to modify the bandwidth and the pattern in the axial direction.

Figure 22:
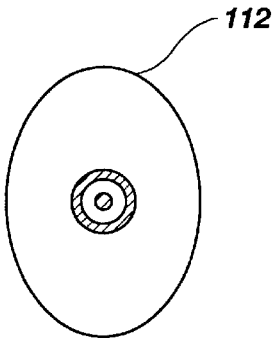
FIG. 22 is an end view of an oval rim.
Figure 23:
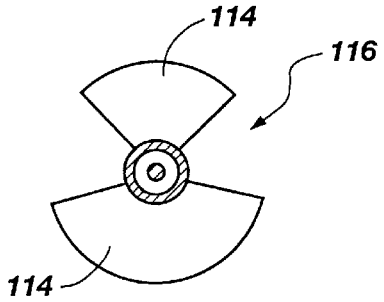
FIG. 23 is an end view of a sectored rim.
Figure 24:
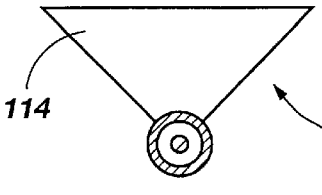
FIG. 24 is an end view of a sectored rim.
Figure 25:
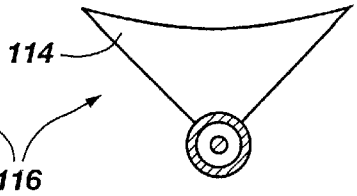
FIG. 25 is an end view of a sectored rim.
Figure 26:
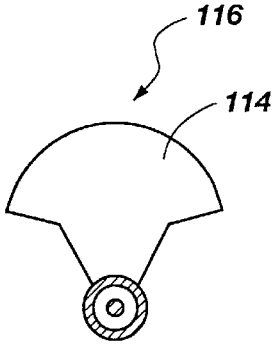
FIG. 26 is an end view of a sectored rim.

FIG. 22 is an end view of a rim 112 of a stub element, where the rim is no longer circular in the plane of the stub element, but is instead oval. Alternative embodiments include making the shape any desired polygon. Changing the shape of the rim 112 enables modification of the radiation pattern in the azimuth.

FIGS. 23, 24, 25 and 26 are all various illustrations of sectorial rims 114 of a single coaxial transverse stub element 116. The number of sectors can be modified in order to change phase distribution of the stub element 116.

Figure 27:
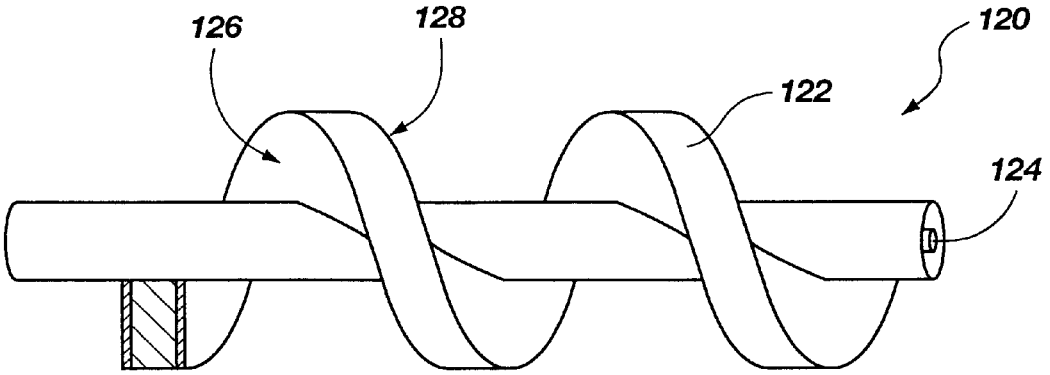
FIG. 27 is a profile view of a coaxial continuous transverse stub element array which has a helical structure.

FIG. 27 is a perspective view of a continuous transverse stub element array structure 120 which forms a helical winding 122 about the core element 124. In other words, there are only two stub elements 126, 128, but they travel along the entire length of the array structure 120, winding around the core element 124.

In essence, the preferred and alternative embodiments of the present invention provide a continuous transverse stub element structure which is applicable to both antenna and filter applications, depending on whether the stub elements are radiating or reactive. The array structure provides omnidirectional capability, two dimensional steering capability, gain control, beam shape control, low cost, a phased array antenna design, millimeter wavelength capabilities, small size relative to other designs, and low loss, high Q factor filter designs.

It is to be understood that the above-described arrangements are only illustrative of the application of the principles of the present invention. Numerous modifications and alternative arrangements may be devised by those skilled in the art without departing from the spirit and scope of the present invention. The appended claims are intended to cover such modifications and arrangements.

What is claimed is:

1. An antenna array structure formed from a plurality of continuous transverse stub elements in a coaxial relationship, said array structure comprising:

a plurality of cylindrical segments, wherein each of the plurality of cylindrical segments has a rim at a top end and at a bottom end, wherein each rim extends transversely away from the cylindrical segment relative to a longitudinal axis, wherein the plurality of cylindrical segments are longitudinally separated from each other, and wherein the plurality of cylindrical segments are comprised of at least a dielectric material;

a core element parallel to the longitudinal axis and around which the plurality of cylindrical segments are disposed to thereby form a coaxial relationship therewith;

wherein the plurality of cylindrical segments and the core element are coated with a thin and continuous conductive layer of material, and wherein a transverse stub element is formed from immediately adjacent cylindrical segments; and a coupling end which is electrically coupled to a first cylindrical segment of the plurality of cylindrical segments, and to the core element, to thereby provide a feed for received and transmitted signals.

2. The array structure as defined in claim 1 wherein immediately adjacent rims of each transverse stub element are electrically isolated from each other to thereby form an open circuit, resulting in the transverse stub element functioning as a radiating element of an antenna.

3. The array structure as defined in claim 2 wherein immediately adjacent rims of each transverse stub element are electrically coupled to each other to thereby form a short circuit, resulting in the transverse stub element functioning as a non-radiating element of a filter and matching network designs.

4. The array structure as defined in claim 3 wherein the array structure further comprises a matched couplet formed from a radiating transverse stub element which is immediately adjacent to a non-radiating stub element, wherein a plurality of matched couplets are linked in series so as to form a coaxial relationship.

5. The array structure as defined in claim 4 wherein a diameter of the plurality of radiating elements is equal, wherein a diameter of the plurality of non-radiating elements is equal, and wherein the diameter of the plurality of radiating elements is not the same as the diameter of the plurality of non-radiating element.

6. The array structure as defined in claim 1 wherein the plurality of cylindrical segments are approximately equal in length along the longitudinal axis, and approximately equal in diameter.

7. The array structure as defined in claim 1 wherein the plurality of cylindrical segments are variable in length along the longitudinal axis, and variable in diameter.

8. The array structure as defined in claim 1 wherein each rim of the plurality of cylindrical segments are generally circular and approximately equal in diameter.

9. The array structure as defined in claim 1 wherein the rims which form the transverse stub element are characterized as not being identical.

10. The array structure as defined in claim 9 wherein the rims are formed by selecting structural features which are selected from the group of structural features including slope, diameter, continuity, separation from an immediately adjacent rim, thickness, inclination of radiation surface, cross section, distribution of the transverse stub elements, shape of the rim in a plane which is transverse to the longitudinal axis, and the addition of other structures to the rims.

11. The array structure as defined in claim 10 wherein the slope of the rim is selected from the group of slopes including tapering, step-wise segmented, and any combination thereof.

12. The array structure as defined in claim 10 wherein the shape of the rim in a plane which is transverse to the longitudinal axis is selected from the group of shapes including circular, oval, polygonal, and sectorial.

13. The array structure as defined in claim 1 wherein the core element is larger in circumference at predetermined locations to thereby modify impedance matching and radiation characteristics.

14. The array structure as defined in claim 1 wherein the core element further comprises at least two different but conductive materials which are in electrical contact with each other.

15. The array structure as defined in claim 1 wherein the core element further comprises a plurality of protuberances which extend transversely with respect to the longitudinal axis.

16. The array structure as defined in claim 1 wherein a gap between each of the plurality of cylindrical segments is open to air.

17. The array structure as defined in claim 16 wherein the material disposed in the gap between the plurality of cylindrical segments is selected from the group of materials including TEFLON™, low density foam, rexolite, polyethylene, stycast, lexan and other materials of similar electrical properties which provide structural integrity to the array structure.

18. The array structure as defined in claim 16 wherein the material disposed in the gap between the plurality of cylindrical segments is comprised of a plurality of layers to thereby improve features including tunability, beam steering and losses.

19. The array structure as defined in claim 1 wherein a material is disposed in a gap between each of the plurality of cylindrical segments so as to fill the gap.

20. The array structure as defined in claim 1 wherein the thin and continuous conductive layer is comprised of a ferro-electric material.

21. The array structure as defined in claim 20 wherein the ferro-electric material is selected from Barium Strontium Titanium Oxide.

22. The array structure as defined in claim 1 wherein the thin and continuous conductive layer is comprised of a liquid crystal material.

23. The array structure as defined in claim 1 wherein the thin and continuous conductive layer of material is applied as a thin film of relatively uniform thickness.

24. The array structure as defined in claim 23 wherein the thin and continuous conductive layer of material is further comprised of a plurality of relatively thin and continuous conductive layers of material.

25. The array structure as defined in claim 1 wherein a thickness of the thin and continuous conductive layer of material is determined as a function of desired tuning capabilities and loss characteristics of the array structure.

26. The array structure as defined in claim 25 wherein the desired tuning capabilities are achieved as a function of applied biasing voltage to the thin and continuous conductive layer of material.

27. An array structure formed from a single and continuous transverse stub element which is formed around a center conductor in a coaxial arrangement, said array structure comprising:

at least two cylindrical segments, wherein the at least two cylindrical segments include at least two helical rims which extend transversely away from the at least two cylindrical segment relative to a longitudinal axis, wherein the at least two cylindrical segments are separated by a predetermined amount, wherein the at least two cylindrical segments are comprised of a dielectric material, and wherein the at least two cylindrical segments define a single array element;

a core element around which the at least two cylindrical segments are disposed to thereby form the coaxial relationship;

wherein the at least two cylindrical segments and the core element are coated with a thin and continuous conductive layer of material, and wherein the stub elements are formed from immediately adjacent rims of the at least two cylindrical segments; and a coupling end which is electrically coupled to the at least two cylindrical segments and to the core element, to thereby provide a feed for received and transmitted signals.

28. A method for providing an omnidirectional array structure formed from a plurality of continuous transverse stub elements in a coaxial relationship, said method comprising the steps of:

(1) forming the plurality of continuous transverse stub elements, wherein a single transverse stub element is formed at a junction of two immediately adjacent but separate spool-shaped segments, wherein each of the plurality of continuous transverse stub elements is comprised of a dielectric material;

(2) forming a core element around which the plurality of continuous transverse stub elements are disposed to thereby form a coaxial relationship;

(3) coating the plurality of continuous transverse stub elements and the core element with a thin and continuous conductive layer of material; and (4) providing a coupling end which is electrically coupled to a first transverse stub element and to the core element, to thereby provide a feed for receiving and transmitting signals.

29. The method as defined in claim 28 wherein the method further comprises the step of forming a radiating element of an antenna by electrically isolating immediately adjacent rims of each transverse stub element to thereby form an open circuit.

30. The method as defined in claim 29 wherein the method further comprises the step of forming non-radiating element by electrically coupling immediately adjacent rims of each transverse stub element to thereby form a filter and matching network designs.

31. The method as defined in claim 30 wherein the method further comprises the steps of:

(1) coupling a radiating element together with a non-radiating element to thereby form a stub element matched couplet; and (2) linking in series a plurality of the stub element matched couplets.

32. The method as defined in claim 31 wherein the method further comprises suppressing coupler-radiator reflections through destructive interference of radiating and non-radiating stub element matched couplets.

33. The method as defined in claim 31 wherein the method further comprises scanning broadside by using the radiating and non-radiating stub element matched couplets.

34. The method as defined in claim 31 wherein the method further comprises the step of modifying bandwidth characteristics of the array structure by selectively modifying structural features of the continuous transverse stub elements.

35. The method as defined in claim 34 wherein the method further comprises the step of modifying at least one rim of the continuous transverse stub elements, wherein the modifications include altering a slope, diameter, continuity, separation from an immediately adjacent rim, thickness, inclination of radiation surface, cross section, distribution of the transverse stub elements, shape of the rim in a plane which is transverse to the longitudinal axis, and the addition of other structures to the rims.

36. The method as defined in claim 35 wherein the method further comprises the step of modifying a shape of the rim in a plane which is transverse to the longitudinal axis to thereby control an azimuth of a radiation pattern of each continuous transverse stub element.

* * * * *